US005274309A

United States Patent [19]

Leupold

[11] Patent Number: 5,274,309

[45] Date of Patent: Dec. 28, 1993

[54] HOLLOW CYLINDRICAL MAGNETIC FLUX SOURCE FOR IMAGE DETECTORS

[75] Inventor: Herbert A. Leupold, Eatontown, N.J.

[73] Assignee: The United States of America as represented by the Secretary of the Army, Washington, D.C.

[21] Appl. No.: 940,149

[22] Filed: Sep. 3, 1992

[51] Int. Cl.[5] ..... G09G 1/04; H01F 7/02

[52] U.S. Cl. ..... 315/382; 315/5.35; 335/306

[58] Field of Search ..... 315/382, 5.34, 5.35; 335/306

[56] References Cited

U.S. PATENT DOCUMENTS

| | | | |
|---|---|---|---|
| 4,835,506 | 6/1989 | Leupold | 335/306 |
| 4,837,542 | 6/1989 | Leupold | 335/306 |
| 4,839,059 | 6/1989 | Leupold | 335/210 |
| 4,887,058 | 12/1989 | Leupold | 335/216 |
| 5,216,401 | 6/1993 | Leupold | 335/306 |

OTHER PUBLICATIONS

Leupold et al., *A Catalogue of Novel Permanent-Magnet Field Sources*, paper No. W3.2, 9th International Workshop on Rare-Earth Magnets and their Applications, 1987, Bad Soden, FRG.

*Primary Examiner*—Gregory C. Issing

*Attorney, Agent, or Firm*—Michael Zelenka; William H. Anderson

[57] ABSTRACT

An image detecting device is disclosed wherein an image detector is mounted within a rare earth permanent magnet structure with a hollow cavity and an access port that passes through the structure and thereby accessing the cavity. The shell is permanently magnetized to produce a substantially uniform magnetic field in the cavity. The shell's magnetization is the resultant of two magnetization components M1 and M2. M2 components are uniform in both magnitude and direction while M1 components are uniform in magnitude but not uniform in direction. Preferably, the magnitudes of the M1 and M2 components are substantially equal to each other but aligned in opposite directions in regions adjacent to the access port. The image detector located within the cavity of the magnet is oriented such that the magnetic flux in the cavity flows in the same direction as the electron beam passing through the cavity.

5 Claims, 2 Drawing Sheets

HOLLOW CYLINDRICAL MAGNETIC FLUX SOURCE FOR IMAGE DETECTORS

GOVERNMENT INTEREST

The invention described herein may be manufactured, used, and licensed by or for the Government for governmental purposes without the payment of any royalty to me.

FIELD OF THE INVENTION

This invention relates to high-field, rare-earth permanent magnets. More specifically, it relates to permanent magnet structures and techniques for providing distortionless access to magnetic field sources for image detecting applications.

BACKGROUND OF THE INVENTION

Various electronic devices such as x-ray/UV telescopes and space probes require a controlled uniform magnetic field to facilitate focusing the electron beam necessary for the translation of detected images. In the past, those concerned with these devices were limited to massive structures that contained bulky power supplies and an access port that distorted the internal working magnetic field. Therefore, such structures were not optimal for image detecting applications.

With the advent of rare-earth permanent magnets (REPM), however, these problems may be eliminated. Due to high saturization magnetization and high coercivity of REPMs, REPMs provide a high flux density in a small space and preserve that flux in the face of very high damaging fields. Today, there are a class of conventional magnetic structures which are capable of producing such distortionless fields. These structures comprise a magnetic shell and a hollow cavity in which the field is located. Examples of such magnets are disclosed in the following references, which are incorporated herein by reference:

Leupold, U.S. Pat. No. 4,835,506, entitled "Hollow Substantially Hemispherical Permanent Magnet High-Field Flux Source;"

Leupold, U.S. Pat. No. 4,837,542, entitled "Hollow Substantially Hemispherical Permanent Magnet High-Field Flux Source for Producing a Uniform High Field;"

Leupold, U.S. Pat. No. 4,839,059, entitled "Clad Magic Ring Wigglers;" and

Leupold et al., "A Catalogue of Novel Permanent-Magnet Field Sources," Paper No. w3.2, 9th International Workshop on Rare-Earth Magnets and Their Applications, pp 109–123, August 1987, Bad Soden, FRG.

These references show a number of different compact permanent magnet configurations capable of producing uniform magnetic fields of unusually high intensity. In general, these permanent magnet structures include a shell of magnetic material and a cavity in which the field is located. Access ports of various sizes, shapes and locations pass through the shell and communicate with the cavity.

Those concerned with image detection have shown interest in utilizing permanent magnet structures described above. More specifically, there is great interest in the light-weight low profile versions of these structures: the half-cylinder and the meridional "igloo" or hemisphere, respectively. Essentially, these structures are created by dividing the spherical or cylindrical shell in half along its meridian and attaching a perfect diamagnet (superconductor) or dividing the shell along its equator and attaching a passive ferromagnet (i.e. iron) to the half-shell's open end. Such a structure preserves the internal magnetic field while reducing the size and weight of the full structure. Depending on which material is used as the base plane, the orientation of the internal field with respect to the base plane can be varied. In particular, a superconductive base plane that passes through the magnetic poles of the structure creates an internal field parallel to the plane of the superconductor, whereas a ferromagnetic (i.e. iron) base plane that passes through the shell's equator preserves an internal field perpendicular to the ferromagnet.

Although these structures provide a choice for internal field orientation, any access to that field through port holes would seriously distort the field. As noted above, this distortion is undesirable in image detection applications and thus, should be eliminated.

SUMMARY OF THE INVENTION

Accordingly, the general purpose of this invention is to utilize a high intensity, permanent magnet structure to provide a distortionless magnetic field in its working cavity for focusing an image detector's electron beam. To attain this, the present invention contemplates placing an image detecting device within the working cavity of a permanent magnet structure having a permanently magnetized shell, with an access port, that produces a substantially uniform magnetic field in the working cavity. The uniform field can focus an electron beam generated when the image detector detects radiation entering the cavity through the access port.

Essentially, the shell's magnetization is the resultant of the magnetization components of M1 and M2. M2 components are uniform in both magnitude and direction while M1 components are uniform in magnitude but not uniform in direction. Preferably, the absolute magnitudes of the M1 and M2 components are substantially equal to each other and, in regions adjacent to the access port, they are aligned in opposite directions so as to cancel each other leaving a resultant of zero magnetization. The image detector located within the cavity of the magnet can be oriented such that the magnetic field in the cavity flows in the same direction as the electron beam passing through the cavity from the detector's cathode to its anode terminal. Depending on the shape of the shell and the magnitude and direction of M1 and M2, an access hole can be bore at various angles to the working cavity's magnetic field.

In one embodiment of the invention, the shell and the cavity are concentric half-cylinders where the shell's open end is enclosed by a planar plate. The access port includes a narrow gap located at the meridian of the structure where the planar plate and half-cylindrical shell connect. This region, where the magnetization of the shell (M1+M2) is zero, is the structure's meridional region and, as such, the structure is called a meridional igloo.

In another embodiment of this invention, the magic ring, the shell and the cavity are a concentric ring and cylinder, respectively, such that an access port is created in the plane of the ring's axis. As with the meridional igloo, the shell material in this region is constructed to have zero magnetization. As such, the material can be removed without affecting the magnetic field in the working area.

BRIEF DESCRIPTION OF THE DRAWINGS

The exact nature and application of the embodiment described herein, as well as other objects and advantages thereof, will be readily apparent from consideration of the following specification relating to the annexed drawings.

DETAILED DESCRIPTION

Figure 1A:
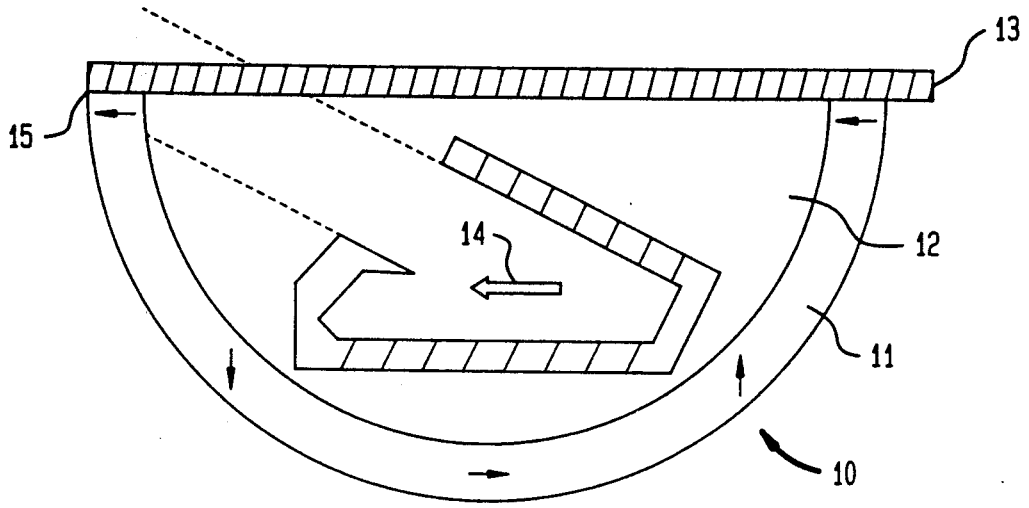
FIGS. 1*a* and 1*b* illustrate an embodiment of the present invention in cross-section, wherein the magnetization components of a REPM have been separated for ease of illustration of the manner in which the REPM is to be magnetized.
Figure 1B:
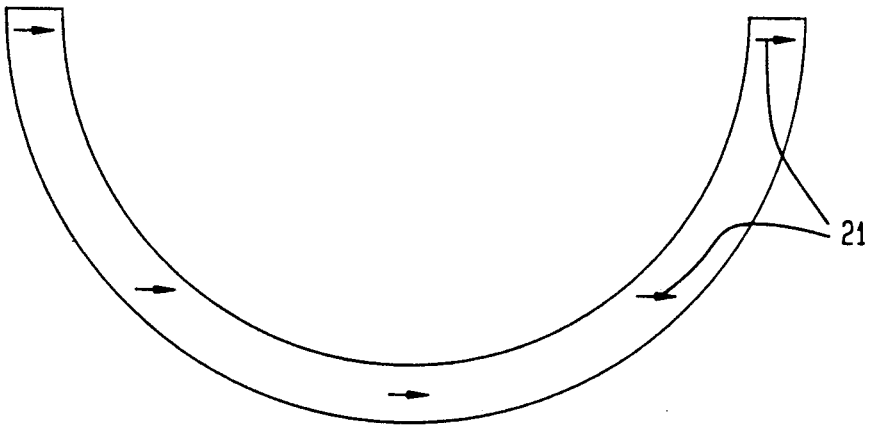
Figure 1C:
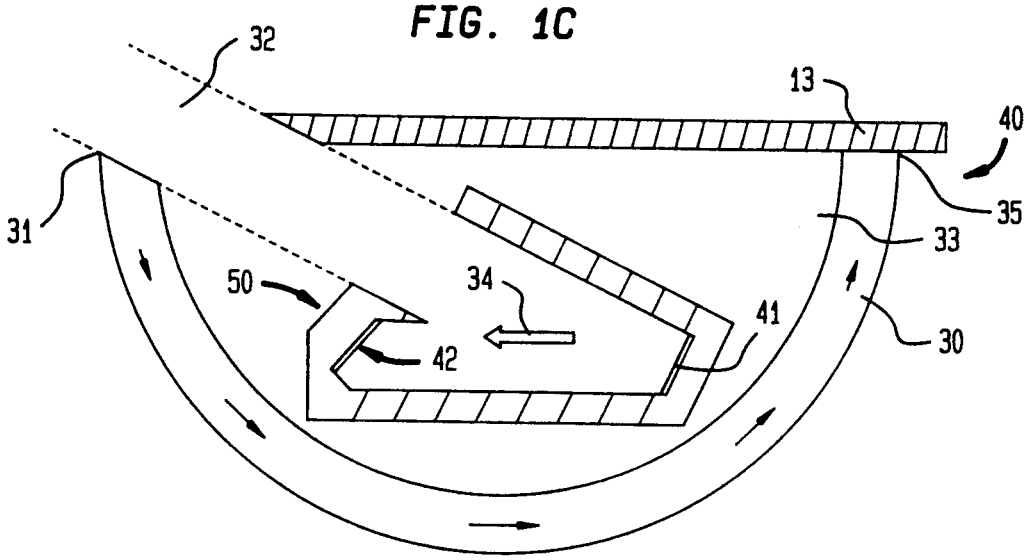
FIG. 1*c* illustrates the resultant magnetization of the REPM shown by vector adding the magnetization components of those shown in FIGS. 1*a* and 1*b* and further illustrates the preferred embodiment of the present invention.

Referring now to the drawings, there is shown in FIG. 1*a* a high field permanent magnet 10 having a half-cylindrical shell 11 and a concentric half cylindrical cavity 12 enclosed by a superconductive planar plate 13. The shell 11 is permanently magnetized to produce a substantially uniform magnetic field 14 in cavity 12 such that field 14 is directed parallel to planar plate 13. As illustrated in FIG. 1*b*, uniform magnetic components (M2) 21 are added to each magnetization component of the half-cylinder shell 11 (shown in FIG. 1*a*) such that the magnetization at the shell's meridian 15 is eliminated and the magnetic field 14 in the shell's cavity 12 is unaffected. The resulting addition of these two sets of magnetization components is illustrated in FIG. 1*c*. Because resultant shell 30 has a zero magnetization at its meridian 31, removal of material from plate 13 and/or resultant shell 30 in order to provide for access port 32 does not effect the magnetic field 34 in cavity 33. The resultant structure 40 will be further referred as a meridional half-cylinder.

As shown in FIG. 1*c*, image detector 50 is positioned within cavity 33 of the meridional half-cylinder such that the magnetic field 34 is directed across the detector's cathode 41 and anode 42 terminals and in the same direction as the electron beam produced by detector 50. The magnetic field 34 acts to focus the electric beam which is produced in response to images detected. Image detector 50 may be any device such as an x-ray/uv telescope or any image detector which generally requires a focused electron beam to impinge upon an anode. Such devices are well known to those skilled in the art and therefore, need not be described further.

As shown in FIG. 1*c*, radiation enters cavity 33 through access hole 32 and is translated by image detector 50 into an electric beam. As constructed, cavity field 34 will focus this electric beam on to the anode 42 as the electron beam is directed from the cathode 41. The importance of a distortionless magnetic field 34 is evident for proper image detection at the anode 42 of device 50.

Figure 2:
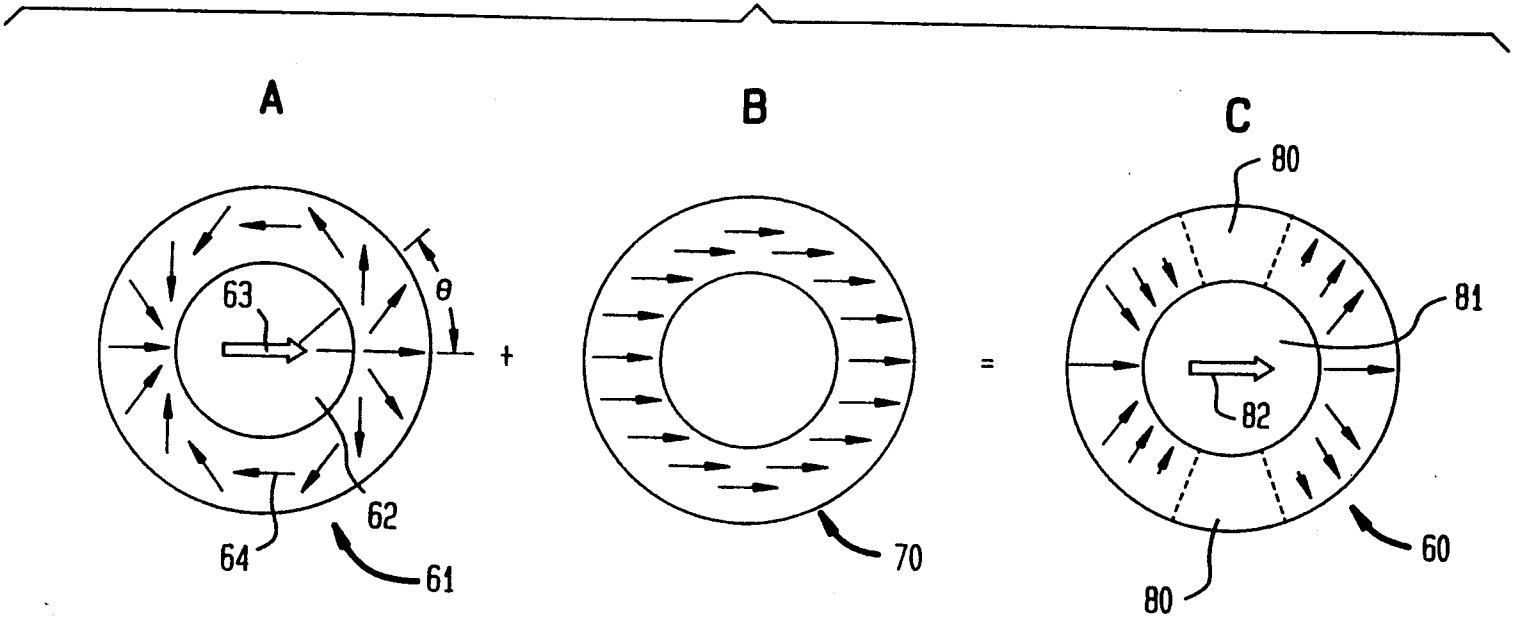
FIGS. 2*a*-2*c* illustrate the construction of a distortionless magic ring wherein a similarly shaped and uniformly magnetized cylindrical shell are superscribed over an REPM structure.

FIG. 2 shows the construction of "magic ring" structure 60 that accomplishes the same objective as the meridional half-cylinder, i.e. to provide distortionless magnetic field for focusing the electron beam produced by an image detector located in its cavity. The "magic ring" 60 is a high field permanent magnet having a full cylindrical shell 61 and a concentric cylindrical cavity 62. Shell 61 is permanently magnetized to produce a substantially uniform magnetic field 63 its cavity 62. As with the meridional half-cylinder described above, magnetization components (M2) 70 are uniformly added to each magnetization component of shell 61 such that the shell's magnetization of the material at an angle to the cavity field 63 is zero. As described above, removal of the material to create an access port 80 has no effect on the magnetic field contained in the cavity 81, because the uniform addition of M2 components 70 to shell 61 does not effect the cavity field 63.

As with the "meridional igloo" described above, distortionless magnetic field 82 can focus an image detectors electron beam representation of energy entering cavity 81 through port 80.

As may be readily appreciated, distortionless access to REPM structures is also described in copending U.S. patent application, Ser. No. 07/892,104, filed Jun. 2, 1992 now U.S. Pat. No. 5,216,401, entitled "Magnetic Field Sources Having Non-Distorting Access Ports." In the application, however, the uniform addition of magnetization components M2 to each of the magnetization components that make up the structure's shell is further disclosed herein. In particular, M2 components 21 provide a magnetization equal in magnitude but opposite in direction to the magnetization of the magnetization component at the meridian 15 of shell 11 containing magnetization components M1 within structure 10. Thus, adding M2 components 21 to every M1 component of structure 10 uniformly, the internal field 14 of structure 10 in not affected. Moreover, the resultant structure 40 has zero remanence components in regions 31 and 35 of shell 30 and a tapered magnetization as shown in FIG. 1C. Thus, removal of material in regions 31 and 35 to provide access port 32 has no distorting effect on the magnetic flux in the cavity.

Although the present invention has been described in relation to two particular embodiments, a ring and a half-sphere, other radially symmetric structures or half-structures (utilizing a superconductor) and other uses will become apparent to those skilled in the art. Therefore, the present invention should not be construed to be limited by the specific disclosure herein, but only by the appended claims.

What is claimed is:

1. A distortionless image detecting device, comprising:

a rare-earth permanent magnet structure consisting of a shell of magnetic material having a hollow cavity and an access port that passes through said shell and communicates with said cavity, said shell being permanently magnetized to produce a substantially uniform magnetic field in said cavity; and an image detector positioned within the cavity of the magnetic structure such that the magnetic field in the cavity is directed across the detector's cathode and anode terminals in the direction of its electron beam for focusing said beam.

2. The device of claim 1 wherein said magnetic structure is cylindrical in shape with minimal external flux leakage, said cylinder having an access port at its zero magnetization point, said zero point located at some angle to the cavity flux direction.

3. The magnetic structure of claim 2 wherein said cylindrical structure is a magic ring, said magic ring having a full cylindrical shell and a concentric cylindrical cavity.

4. The device of claim 1 wherein said magnetic structure is a meridional half-cylinder, said half-cylinder having an access port at its zero magnetization point on its shell, said zero point located at the meridian of the structure where the shell connects with its planar plate.

5. The magnetic structure of claim 4 wherein said meridional half-cylinder comprises a half-cylindrical shell and a concentric half-cylindrical cavity enclosed by a super-conductive planar plate.

* * * * *